US009291327B2

(12) United States Patent
Rodriguez

(10) Patent No.: US 9,291,327 B2
(45) Date of Patent: Mar. 22, 2016

(54) LIGHT CONDITIONING FOR HIGH-BRIGHTNESS WHITE-LIGHT ILLUMINATION SOURCES

(75) Inventor: Edward Rodriguez, Wakefield, MA (US)

(73) Assignee: Solais Lighting, Inc., Stamford, CT (US)

( * ) Notice: Subject to any disclaimer, the term of this patent is extended or adjusted under 35 U.S.C. 154(b) by 0 days.

(21) Appl. No.: 12/831,222

(22) Filed: Jul. 6, 2010

(65) Prior Publication Data

US 2012/0170263 A1 Jul. 5, 2012

Related U.S. Application Data

(60) Provisional application No. 61/270,349, filed on Jul. 6, 2009.

(51) Int. Cl.

| | |
|---|---|
| ***F21V 1/00*** | (2006.01) |
| ***F21S 4/00*** | (2006.01) |
| ***F21V 21/00*** | (2006.01) |
| ***F21V 5/00*** | (2015.01) |
| ***F21V 29/02*** | (2006.01) |
| ***F21K 99/00*** | (2010.01) |
| ***F21V 23/00*** | (2015.01) |
| ***F21V 29/00*** | (2015.01) |
| ***F21V 29/83*** | (2015.01) |
| *F21Y 101/02* | (2006.01) |
| *F21Y 105/00* | (2006.01) |

(52) U.S. Cl.

CPC . *F21V 5/007* (2013.01); *F21K 9/13* (2013.01); *F21V 23/006* (2013.01); *F21V 29/02* (2013.01); *F21V 29/20* (2013.01); *F21V 29/83* (2015.01); *F21Y 2101/02* (2013.01); *F21Y 2105/003* (2013.01)

(58) Field of Classification Search

CPC ..... F21V 5/007; F21V 29/83; F21V 29/20; F21V 23/006; F21V 29/02; F21K 9/13; F21Y 2101/02; F21Y 2105/003

USPC ..... 362/543–549, 555, 800, 362/249.01–249.03, 311.01–311.05

See application file for complete search history.

(56) References Cited

U.S. PATENT DOCUMENTS

| | | | | |
|---|---|---|---|---|
| 5,890,794 | A * | 4/1999 | Abtahi et al. | 362/294 |
| 6,623,142 | B1 * | 9/2003 | Lippmann et al. | 362/293 |
| 7,758,223 | B2 * | 7/2010 | Osawa et al. | 362/547 |
| 7,824,076 | B2 * | 11/2010 | Koester | 362/294 |
| 7,914,162 | B1 * | 3/2011 | Huang | 362/92 |
| 2002/0048177 | A1 * | 4/2002 | Rahm et al. | 362/555 |
| 2002/0191396 | A1 * | 12/2002 | Reiff et al. | 362/246 |
| 2004/0120160 | A1 * | 6/2004 | Natsume | 362/544 |
| 2004/0170018 | A1 * | 9/2004 | Nawashiro | 362/244 |
| 2010/0207534 | A1 * | 8/2010 | Dowling et al. | 315/186 |

FOREIGN PATENT DOCUMENTS

| | | | | |
|---|---|---|---|---|
| WO | WO2009/048956 | * | 4/2009 | F21V 9/00 |

* cited by examiner

*Primary Examiner* — Donald Raleigh
(74) *Attorney, Agent, or Firm* — Kristofer E. Elbing

(57) ABSTRACT

In one general aspect, the invention features an illumination source that comprises a housing and a plurality of LED illumination elements that are mounted proximate each other in a central cluster with respect to the housing and leaving a peripheral space around the cluster, with the peripheral space being significantly larger than a separation between the LED illumination elements in the cluster. A transparent housing cover is mounted with respect to the housing in front of an axis of illumination of the LED illumination elements. A tinted transparent housing cover and/or a smoothing LED can also be employed.

19 Claims, 8 Drawing Sheets

LIGHT CONDITIONING FOR HIGH-BRIGHTNESS WHITE-LIGHT ILLUMINATION SOURCES

CROSS-REFERENCE TO RELATED APPLICATION

This application claims the benefit of U.S. provisional application No. 61/270,349 filed on Jul. 6, 2009, which is herein incorporated by reference.

FIELD OF THE INVENTION

The invention relates to improvements in the characteristics of light output of illumination sources based on Light Emitting Diodes (LEDs), including improvements in color temperature and/or light uniformity of LED sources.

BACKGROUND

There is considerable attention being given to the use of high brightness LED (HBLED) technology as a light source to replace traditional incandescent lamps. The catalyst for introduction of white LEDs, first as indicators, and later for viable commercial illumination sources, has primarily been due to development and refinement of blue-LED material-science processes, in conjunction with appropriate yellow-phosphor coatings for what is termed "secondary emission". The science of secondary emission has been long understood by those skilled in lighting technology and such science has previously provided the basis for all fluorescent and most other gaseous discharge lamps.

In such a process of secondary emission, monochromatic light, generated within a phosphor-coated LED chip, causes the phosphor to emit light of different wavelengths.

This has resulted in white HBLEDs, with rating of up to a few watts and lumen outputs, depending on color temperature, exceeding 70-100 lumens per watt.

The mechanism is much like that in a gaseous discharge tube lamp where ultraviolet light excites the phosphor coating on the inside of an evacuated glass tube to create visible white light. Interestingly, many of the difficulties in refining the technology of white LEDs relate to the same issues experienced with gaseous discharge lamps in mastering phosphor composition and deposition processes to achieve consistency and desired performance.

The fundamentals of incandescent lamp design have changed little in the last 75 years. Similarly, the design and performance of fluorescent lamps have not changed substantially in the last 30 years. That is to say, both incandescent and fluorescent lamp processes are considered to be mature technologies, with very little gain in efficacy (lumens per watt) expected in the near future.

High brightness LED's, on the other hand, are experiencing some gain in efficacy each year as scientists refine techniques for light extraction from the chip and slowly master the composition and deposition of phosphors. When many of these factors are better understood in the future and efficacy is greatly improved (a projection accepted by most industry experts) the LED lamps will be far more easily accepted and many of the present challenges will be mitigated. Until that happens, however, there are compelling reasons to develop novel techniques to enhance what now exists so as to accelerate commercial viability.

Two factors are driving the substantial interest in white-emitting HBLEDs as a candidate to replace incandescent lamps in a large number of general illumination applications: longevity and energy conservation.

The typical one-watt white HBLED, if used properly, is expected to have a useful operating life of over 50,000 hours, dramatically longer than the 750-2,000 hours of a typical incandescent lamp and much longer than the typical 6,000 hours of a compact fluorescent lamp. HBLEDs can exhibit efficacy of more than 75 lumens per watt, 5-7 times better than either a regular or quartz-halogen version of an incandescent lamp.

While there is significant saving in bulb replacement expense over a number of years, it is the saving in electricity costs which presents the most significant benefit. In conditions of near-continual operation, such as in restaurants, hotels, stores, museums, or other commercial installations, the electricity savings can provide a return on investment, even with relatively high purchase prices, in 18-24 months. The potential for rapid payback is much more evident than for other highly publicized "green" technologies" such as hybrid vehicles, wind turbines, solar power etc.

There is widespread acceptance that white-light LED sources are attractive as possible incandescent replacement lamps, especially in those types where the LED lamp is at its best, namely as reflector-type lamps such as PAR 30, PAR 38, or MR16. LEDs are by their nature directional light sources in that their light is emitted typically in a conical 120-150 degree beam angle, whereas an incandescent lamp tends to radiate in a near 360-degree spherical pattern and needs loss-inducing reflectors to direct light. Compact fluorescent lamps, because they are very difficult to collimate, are very inefficient when used as directional light sources.

The LED lamp starts out in a better position in spot or flood lamp applications because of its inherent directionality. In fixtures for ceiling downlighting, outside security, or retail merchandise highlighting, the need is for directional lighting, a factor taking advantage of the LED lamp's inherent emission characteristics. Those with a reasonable knowledge of physics know that a point source of light is best for use with a reflector or collimator. A CFL, being the virtual opposite of a point source, is poor in this respect. An incandescent filament is much smaller but still needs a good-sized reflector. An LED chip, being typically no larger than a millimeter on a side, lends itself to many more options with much smaller reflectors and collimating lenses.

Consequently, while white HBLEDs may alone, or as a partner with the compact fluorescent lamp (CFL), replace incandescent filament lamps, it is in the reflector lamps where the performance and economics of white LEDs appear likely to have the more immediate impact. While the CFL has become widely commercialized, the LED lamp does have certain advantages, which over the long term could give it a substantial marketing edge. Specifically, compared to a CFL, the LED lamp is a) more compatible with standard lamp dimming methodologies b) can more easily operate in low temperature, c) has no mercury content d) retains its efficacy when dimmed e) is essentially immune to shock and vibration and f) is immune to the degradation which CFL's experience with repetitive on/off cycling.

Even with the apparent advantages of the white HBLED lamp and its assumed inevitability as a commercially successful product category, there has yet to be an acknowledged product-leadership candidate; that is, a product which meets the performance and cost criteria necessary for early-adopter, sophisticated, commercial users to accept it on a large scale.

SUMMARY

In one general aspect, the invention features an illumination source that comprises a housing and a plurality of LED illumination elements that are mounted proximate each other in a central cluster with respect to the housing and leaving a peripheral space around the cluster, with the peripheral space being significantly larger than a separation between the LED illumination elements in the cluster. A transparent housing cover is mounted with respect to the housing in front of an axis of illumination of the LED illumination elements.

In preferred embodiments the transparent housing cover can include a plurality of integral lens elements each aligned with an illumination axis of one of the LED illumination elements. The nominal outside diameter of the light can be at least 2.5 inches in diameter. The nominal outside diameter of the light can be at least 3.75 inches in diameter. The nominal outside diameter of the light can be at least 4.75 inches in diameter.

In another general aspect, the invention features an illumination source that comprises a housing and a plurality of LED illumination elements that are with respect to the housing. A tinted transparent housing cover is mounted with respect to the housing in front of an axis of illumination of the LED illumination elements.

In preferred embodiments the tinted transparent housing cover can include a plurality of integral lens elements each aligned with an illumination axis of one of the LED illumination elements. The tinting can be a high-pass filter operative to attenuate shorter wavelength light, so as to increase the lamp CRI (Color Rendition Index) number over what it would be using the same LED illumination elements, but without the high pass filter.

In another general aspect, the invention features an illumination source that comprises a housing, a plurality of LED illumination elements that are with respect to the housing, and a transparent housing cover mounted with respect to the housing in front of an axis of illumination of the LED illumination elements. At least one smoothing white LED is positioned proximate the LED illumination elements and has a power output that is lower than the LED illumination elements. In preferred embodiments, the transparent housing cover can include a plurality of integral lens elements each aligned with an illumination axis of one of the LED illumination elements.

Preferred embodiments of the invention can benefit from a series of methodologies, which, when combined in novel combination, can address the principal considerations in meeting the requirement of a cost-effective, white-light, collimated-beam technology suitable for, but not limited to, PAR 30 and PAR 38 lamps and compatible as a retrofit lamp in applications where incandescent or CFL versions are now used.

Preferred embodiments of the invention can provides for a high-brightness, multiple-LED, reflector-style, AC-mains-operated lamp, intended for white-light general illumination. It can contain a means to regulate current through the LEDs, a means to unify and collimate the multiple light outputs, a means to allow a wide range of lamp brightness control with a standard, single-pole, phase-control dimmer, an improved means for heat removal, and/or a means to control thermal gradients in a way to facilitate component performance expectations over a prolonged operating period.

The following description will be based on the industry standard PAR 30 configuration but it will be seen to be applicable to other reflector-style lamps such as the PAR 20 or PAR 38. For purpose of this description, the PAR 30 designation will be used, although there are some mechanical differences in the versions destined for indoor or outdoor applications, resulting in other designations, such as R30. These have to do with robustness of the glass housing, the thickness and diffusion pattern of the light-emitting glass cover, the overall length of the lamp etc.

Suffice it to say that knowledgeable industry personnel immediately know what is meant when reference is made to a "PAR 30-type lamp" being in a lighting fixture, just as everyone knows what is meant when reference is made to "looking like a regular light bulb," which in industry terms would be the A-19 configuration, found in virtually every household.

For as long as the nearly decade-long period the white LED has been available commercially, firms have introduced LED-based PAR lamps of one kind or another. For example, one might simply arrange, near the 3.75 inch-diameter top surface of the lamp, a round PC board holding a few dozen low-power, white indicator-type LEDs. Until very recently, that approach was taken in 95% of commercialized attempts at incandescent PAR 30 replacement.

The issue is not only whether it is possible to make a solid state PAR 30 lamp or even someday make it cheaply. Rather, a significant challenge is in appropriately addressing the following market criteria.

1. Approximately the same lamp shape as traditional PAR lamps.
2. The same degree of illumination and light-color quality,
3. Sufficient efficacy (i.e. lumens per watt), in order to create an adequate electricity-saving economic investment payback.
4. Credible basis for stating a 30,000 hour-plus estimated operating life.
5. Operation from 120 or 220V AC mains.
6. Capable of, or close to, 0-100% dimmability, in a way compatible with the hundreds of millions of standard, single-pole, phase-control dimmers already in place.
7. Compatible with all global safety-agency and EMI-compatibility standards.
8. Readily available in the range of color temperature and beam angles required of the commercial market.
9. Capable of operation in base-up position in a virtually airtight fixture.
10. Achievement of items 1 though 8 while still providing, in the first year or two, a saving in lamp replacement and electricity costs, greater than the initial lamp cost.

For example, the PAR 30 lamps rated from 45 to 75 watts are the dominant power ranges for that type. If any LED par lamp does not equal the illumination of one of those lamps, it may be virtually unmarketable to mainstream users who are accustomed to a given mount of light for a given fixture.

It is always possible at some point in the future that if electricity costs increased five fold, the design of fixtures and lighting habits in general might have to be dramatically altered, creating a shift to lower power/lower brightness lamps. However, at the present time, there is the widely held view that an acceptably priced LED lamp with 65-75 watt, PAR 30 performance/visual parity, by being a retrofit-compatible lamp, would have more immediate acceptance on a large scale.

There is now a substantial number of PAR-style LED lamps offered for sale and an increasing body of patent-related prior art. From the extensive literature and issued patents, it can be noted that there is a reasonably good awareness, by the various developers, of the basic limitations of HBLEDs in terms of emission patterns, heat removal, and operating characteristics under various conditions of current or voltage.

In other words, those skilled in the art know that there should be ballast-like means to control the current in an LED which, acting somewhat like a negative resistance, can go into a destructive state unless controlled, just like the arc in a fluorescent tube. They also know that, as in all semiconductor diodes, heat is generated in the PN junction essentially proportional to current. Again, the device will go into a destructive mode if the heat is not held to prescribed levels. Finally, they know that light comes off virtually all popular HBLED chips in a very wide angle, typically 100 to 150 degrees, and that beam angle should be reduced significantly before the lamp can be effectively used as an incandescent PAR replacement, where a collimated beam is the primary performance attribute.

Not commonly discussed or addressed by the vast majority of LED lamp makers is the need for phase-control dimming compatibility, beam-angle options, and how the component temperatures affect the estimated operating hours in a typical operating environment. Tens of millions of PAR style lamps are used in commercial/institutional environments where dimming is part of setting the environment. Many prominent restaurant chains typically have preset schedules for brightness levels such as at breakfast, lunch or evening periods.

The vast majority of PAR lamps are now sold in beam angles from 10 to 75 degrees, meaning that HBLED versions need to have similar capabilities Finally, while many claims are made about LED lifetimes being over 50,000 or 100,000 hours, there is no real "proof" of that since no device sold today is based on any technology which even existed 100,000 hours ago. However, experience over 30 years with lower power LED chips and mathematical models of the problem have led to some things becoming better known and appreciated, particularly that LED operating hours are greatly influenced by junction temperature.

While low-current indicator LEDs have been in use for nearly 40 years, with widespread evidence of such LEDs still operating after 10 or 15 years of near-continual use, it is not unreasonable to extrapolate lifetimes for HBLEDs. However, indicator LEDs typically operate at junction temperatures well under 100 C, have a colored-light output, and do not have any phosphor coating.

At this time, it is virtually a given that an LED in an incandescent-replacement lamp, destined for general illumination, will be operating, as a practical matter, with its junction close to, or over, 100 C and that other components in the lamp will also be subjected to an elevated ambient temperature. Consequently, the effect of heat on the LED efficacy and operating life is at the top of the design agenda. Other considerations are important as well in creating a commercially successful lamp.

In one embodiment of the invention, a multiplicity of HBLEDs are surface mounted to a thin printed circuit board. Each LED is mounted in a way which establishes appropriate inter-LED connectivity, but also in a way to enhance heat removal. A fan positioned directly under, and close to, the PCB board cools the PC board in a highly effective manner. The appropriate cooling is a sharp departure from existing patent art and practices in that it is achieved without use of any heat sinks or metallic lamp housing.

In practice the ultimate objective is to reduce the temperature of the LED PN junction. The heat generated in such a junction may need to be transferred to a succession of materials and interfaces before reaching the ambient air. These materials or interfaces are known as thermal resistances. The importance and mechanisms of these thermal resistances are described in *Cooling a High Density DC-DC Converter Impacts Performance and Reliability*, by E. Rodriguez, Power Electronics Magazine (June 1999), which is herein incorporated by reference [1].

The cumulative thermal resistance from the LED PN junction to the surrounding air can be determined, with sufficient accuracy, in such an arrangement as this embodiment, and those skilled in the art of semiconductor thermal management are familiar with the means to establish such a characterization through the use of thermocouples, associated instrumentation and appropriate techniques.

The LEDs are powered by a high-frequency switching power-supply circuit, which converts the AC-mains voltage to an appropriate level of DC voltage and, more importantly, regulates the current through the LEDs in such a way that they will have the desired power level and light output. The control circuit incorporates provisions so that a decrease in the input AC RMS voltage by means of a standard, single-pole phase-control dimmer will result in a relatively proportional decrease in the RMS DC current though the LEDs, thereby decreasing their brightness.

Most commercial switching power supplies incorporate provisions to maintain a constant output voltage in the presence of AC line voltage variations. This normally desirable characteristic prevents such power supplies from allowing load power control (i.e. variable brightness) by means of a standard phase control lamp dimmer. Such power supply regulation circuitry, used perhaps in 99% of all switching power supply applications, works in an LED dimming application to defeat the proper function of the dimmer and the result is instability and lamp flickering.

Therefore, the embodiment purposely does not incorporate certain aspects of the normal regulation function so as to allow the dimmer to affect the LED power as desired. In other words, the power to, and brightness of, the LED lamp, just like the traditional incandescent lamp, must essentially track the variations of the AC mains RMS voltage. It is also known to those with some experience in designing regulation circuits for LEDs that there are still other instability effects due to the inductive and capacitive components within a dimmer used for EMI suppression. These can interact with switching power supply circuits and cause undesirable flickering when an attempt is made to dim. Consequently, provisions have been added to minimize this instability.

Furthermore, LEDS have certain non-linear characteristics which can cause anomalies when controlled by dimmers. That is, it is common to observe LED lamps snapping on or off at certain brightness levels rather than exhibiting a smooth full range of dimming. The proposed embodiment addresses this issue also The switching power supply, to function properly and at the same time meet certain cost objectives, necessarily incorporates one or more electrolytic capacitors. It is a well established practice in the electrolytic capacitor industry to derate the estimated operating life of such capacitors as a function of operating temperature. Specifically, such capacitors are normally specified for an estimated life of 2,000 hours at a given temperature.

In that regard it can it probably is safe to say that over 90% of commercial electrolytic capacitors are rated for a maximum of either 85 C or 105 C (meaning 2,000-hour life at the temperature rating for that type). It is generally accepted practice to double the expected life for every 10-degree decrease in temperature. That is, an 85 C capacitor would have an estimated life of 2,000 hours at 85 C, a 4,000 hour life at 75 C, and an 8,000 life at 65 C, and so on.

This means that one must choose a capacitor on the basis of its basic capacitor parameters, determine the potential ambient temperature and then see if either an 85 C or 105 or even 125 C (more expensive and less available), when working backward from the 2,000 hour figure, can provide the desired operating life at the estimated worst-case ambient temperature inside the lamp immediately adjacent to the capacitor.

In a PAR-type lamp operating in a base-up position in an airtight ceiling fixture, in a generally high temperature ambient as may be found in summer months in the southern U.S., it would not be unusual, without specialized cooling, to see internal lamp housing temperature exceed 70-80 C.

If the capacitors cannot match the estimated lifetime of the LEDs, then the overall purpose of the LED lamp may be severely compromised. In other words, if the LEDs can operate for 50,000 hours but the capacitor for only 16,000 hours, the economic payback can be greatly reduced and the reliability compromised as well. Therefore, it is important to take advantage of thermal gradients inherent in the overall LED heat-removal system and if possible to create additional gradients so as to further thermally isolate the capacitor from the LED created heat. Perfect isolation is not possible, but a simple, quantifiable, 10 C improvement can double capacitor life.

Those skilled in power electronic design know that other types of capacitors, such as ceramic or film types, are relatively immune to these issues in this application but the size and cost of such capacitors would generally be prohibitive. It is also possible, with a circuit design to exhibit high LED ripple current, to allow usage of small values of input filter capacitors, facilitating use of the aforementioned ceramic or film type. However, allowing high ripple current in the LED creates inefficiencies by forcing the LED to operate, during a portion of each AC mains cycle, in a higher than desired peak current mode. In other words, the efficacy realizable with an HBLED is not a function of RMS current but rather the instantaneous current.

In the proposed embodiment, such an electrolytic capacitor as described is located in the screw base of the lamp and is somewhat thermally isolated from the heat in the LED compartment by the power supply PC board. In other words, the electrolytic capacitor essentially tracks the temperature of the surrounding ambient rather than the heated internal lamp ambient.

The surface mounted LEDs are arranged in a symmetric pattern on a printed circuit board (PCB) substrate having appropriate traces to interconnect the LEDs as desired and to make provisions for connection to a DC operating voltage. Over each LED is placed a small, conically shaped, optically clear plastic lens, serving as a collimating lens. The multiplicity of lenses for the multiplicity of LEDs can consists of separate lenses or can be fabricated as a precision, multi-element, monolithic structure. That is, they are molded as part of an overall transparent, top-surface lamp cover. When the lenses assembled into the lamp, openings in the bottoms of the lenses mate with the LED top surfaces and function so as to collimate the light from all LEDs into a single focused beam.

In a principal embodiment, the PCB having the LEDs is of a type known as a metal core board (MCB), sometimes called an insulated metal substrate (IMS). Unlike a conventional epoxy-laminate PCB, the MCB employs a thermally conductive substrate, usually copper aluminum. Onto that metal substrate is laminated a thin layer of insulating film, typically a polyimide material. Finally, a thin copper foil is laminate on top of the insulating film. At that point, the basic "PCB" material can be processed much like a regular PCB in that the copper pattern can be appropriately etched into the copper foil layer.

Because the metal substrate is far more thermally conductive than the glass-epoxy laminate of a regular PCB, heat can be removed from PCB-mounted dissipative components more easily and creatively. This skilled in the art of power electronics and particular in the design of high brightness LED products are familiar with the advantages of such MCB's.

There are also available certain technologies which accomplish the same end as the just-described MCB but instead employ an oxide layer instead of the polymide film and use thick film metallization instead of copper foil as the top circuit metallization. Another process, developed by IRC, is such a technique. While the preferred embodiment herein is based on the MCB approach, there are possible variations where the Anotherm process could offer certain versatility wherein the PCB must have a 3-dimensional aspect. For example, the Anotherm can allow circuit patterns to be placed on all surfaces of a cube—something not generally possible with conventional PCB processing.

Prior mention has been made of the novel air-moving system. In the one embodiment, a miniature fan is positioned directly under the PC board holding the LEDs. Heat from the LEDs is spread laterally across the surface of the PC board by a distinctive multi-segment copper pattern, each segment being substantially larger than the associated LED. Heat from each of those top-side copper areas is transferred, through the insulating film. The ability of the arrangement to transfer heat efficiently from the top side copper to the bottom side material is a function of the thickness of the insulating film and the surface area of each top-side copper area associated with each LED. This heat transfer efficiency can be quantified as what is called the "thermal resistance" from the top side copper to the metal substrate. Reference [1], supra, more fully describes the process.

The fan directs air toward the heated bottom side of the PC board in a perpendicular manner known as impulse cooling.

In this configuration, air is directed at the PC board and then, after impinging on its surface, moves 90 degrees laterally and is expelled from the lamp housing. In the proposed invention, the entire heat-exchange system—air intake, air exhaust, and fan—is essentially contained in a thin "hockey puck" type cylinder. Unlike a number of prior art LED lamps, including those employing fan, liquid or piezo-effect cooling, there are no additional metal heat sink or fins structures required for highly efficient cooling. The result is an extremely compact, light weight, lower-cost, heat exchange system.

It is here where another aspect of the system is considered. In a light fixture where the socket end is closed to any external air (known as an airtight fixture) a lamp, in a base-up position, can result in heat build up in the socket area. For example, a 40-watt incandescent lamp in a ceiling-mounted airtight fixture can easily result in temperatures above 200 C in the socket region. Similarly, a 15-watt LED lamp, although generating fewer overall watts, could still easily cause heat buildup and temperature above 100 C near the base of the lamp.

In such a situation, the LED lamp, starting from an ambient of 100 C, could not possibly survive since the internal LED junction temperature would likely be 50-75 C higher. This inability of LED lamps to survive in the resulting internal ambient temperature, in a partly or fully sealed fixture, has been one of the most serious obstacles to acceptance of high brightness LED lamps in commercial lighting.

There have been efforts in recent prior art to incorporate fans of some type to act as a heat exchanger to minimize the internal lamp components from rising too far above the ambient temperature. However, these efforts are predicated on the lamp being operated in open air or in a fixture with substantial access of all lamp surfaces to the surrounding air. A problem can arise, however, when a lamp is inserted into a fixture in such a way that the incoming air is not cool but is partly or fully the same air which was just heated. Such fixtures exist in some PAR 30 type applications.

There are lamps available where the intake vents are near the screw base of the lamp and the exhaust vents are near the emitted light top surface of the lamp. In these configurations, in a fairly tight fixture, the intake vents are never exposed to cool ambient air and internal lamp heat buildup occurs, virtually negating the effects of the fan. The fan is acting as a warm-air circulator rather than a warm/cool air exchanger.

In this embodiment, air into and out of the fan is baffled in a way that intake air can only easily enter through certain vents on the plastic lamp-housing periphery and exhaust air can only easily exit through other areas on the plastic housing periphery. The intake and exhaust vents are angularly displaced (rather than longitudinally displaced as in prior art) such that heated exhaust air does not meaningfully mix with cool intake air. This bifurcation of airflow to and from the same surrounding air in the vicinity of the light-emitting lamp surface means that the lamp becomes relatively independent of whether the lamp is in an open or relatively air tight fixture.

DESCRIPTION OF DRAWING FIGURES

FIG. 1*a* is a cross-sectional view of an illustrative embodiment of a solid state lamp according to the invention that shows its principal components;

FIG. 1*b* is a diagram that shows an arrangement of LEDs on a substrate for use in the lamp of FIG. 1*a;*

FIG. 1*c* is a perspective view that shows the assembled solid state lamp of FIG. 1*a* in three dimensions;

FIG. 1*d* is a diagram that shows the electrical and thermal attachments areas on of an LED for the solid state lamp of FIG. 1*a;*

FIG. 1*e* is a cross-sectional view of a metal core board for use with the lamp of FIG. 1*a;*

FIG. 2*a* is a diagram that shows an LED-related PC board pattern prior to assembly for the lamp of FIG. 1*a;*

FIG. 2*b* is a diagram that shows the area of FIG. 2*b* after assembly of an LED for the lamp of FIG. 1*a;*

Figure 1A:
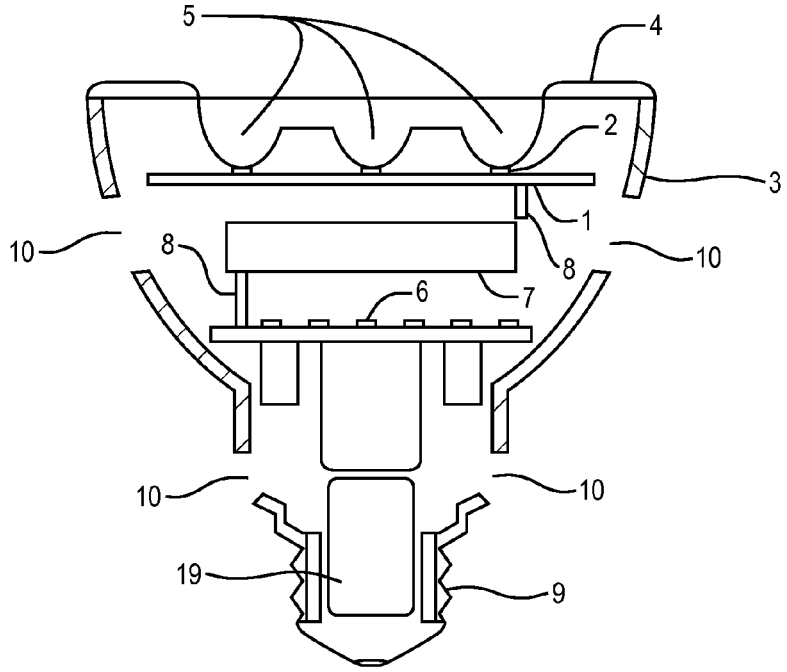
Figure 1B:
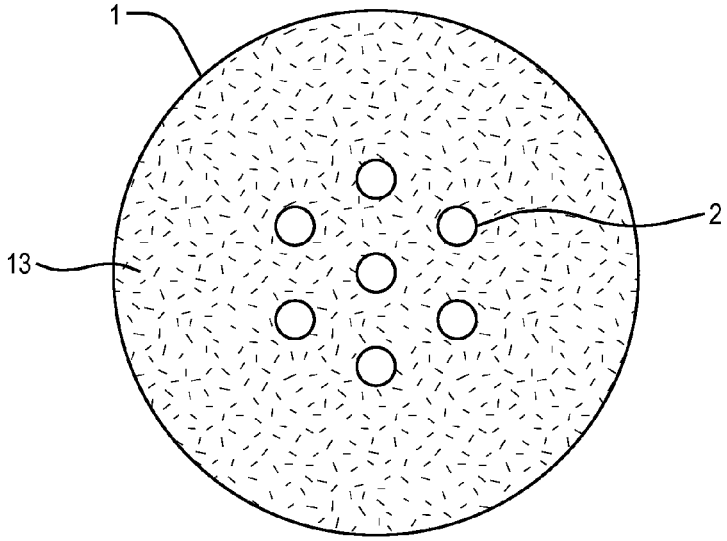
Figure 1C:
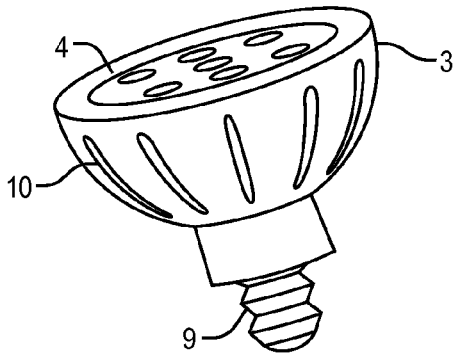
Figure 1E:
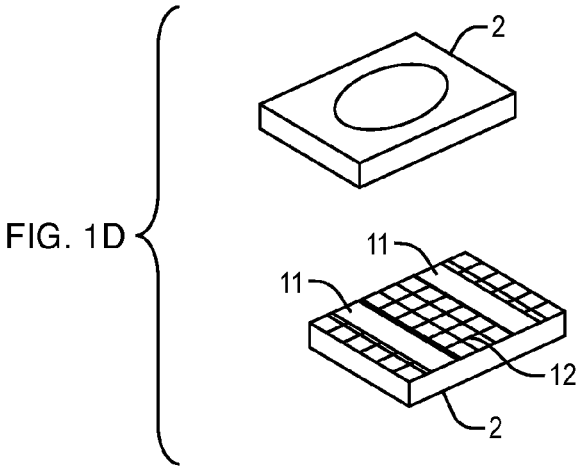
Figure 1E:
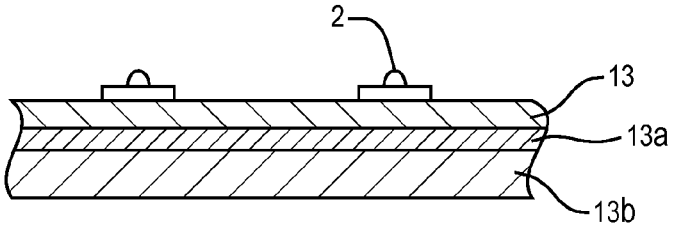

FIGS. 5*a* and 5*b*-5*d* are diagrams showing two optional implementations of air flow diagrams that show the airflow pattern of the lamp of FIG. 1*a;*

Figure 6A:
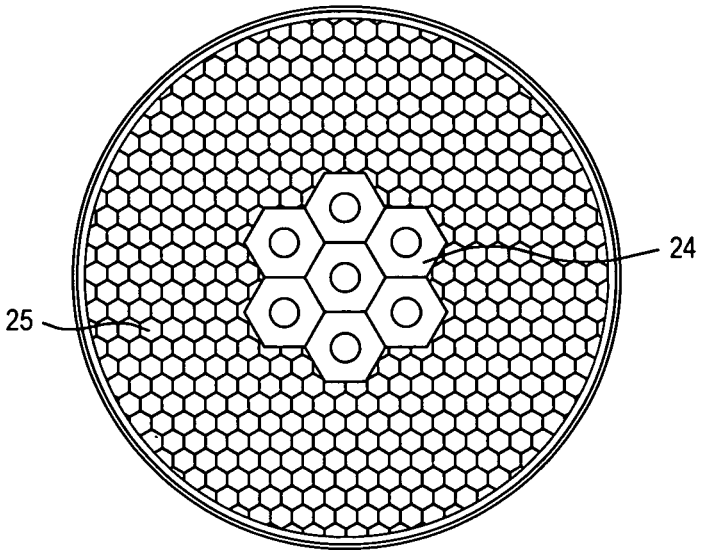

FIG. 6*a* is a plan view of a multi-segment lens array for use with the lamp of FIG. 1*a;*

Figure 6B:
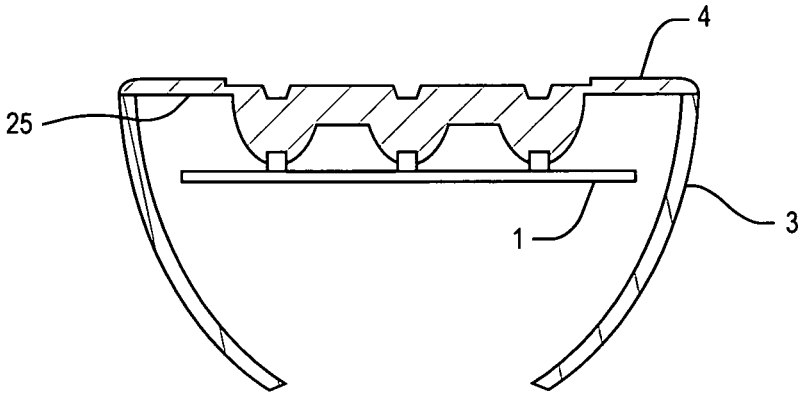
Figure 6C:
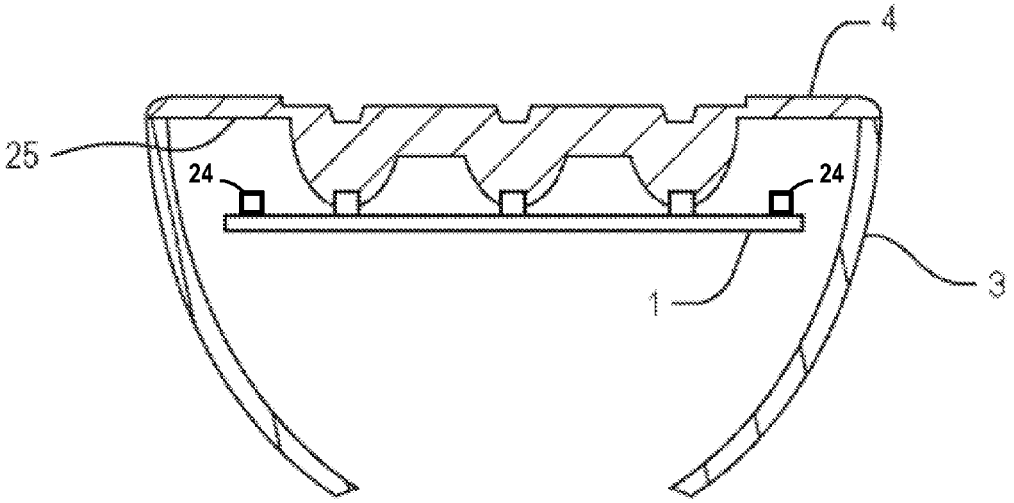

FIG. 6*b* is a cross-sectional view of the multi-segment lens array of FIG. 6*a*; and FIG. 6*c* is a cross-sectional view of an alternate embodiment of the multi-segment lens array of FIG. 6*a*.

DETAILED DESCRIPTION OF ILLUSTRATIVE EMBODIMENTS

In the proposed embodiment of FIG. 1, a PC board substrate 1 contains a multiplicity of surface-mounted high brightness LEDs (HBLEDs) 2 arranged in symmetric pattern. Also in the housing is a PC board 6 containing power supply circuitry. The two PCB's are appropriately positioned inside a plastic housing 3. On top of the housing is an optically clear cover 5 that contains integral collimating lenses 4. Those skilled in the art know that it is also possible to have individual lenses which are positioned appropriately by the lens cover or by lens holders for each lens. The power supply PCB 6 is a made of a conventional copper and epoxy-glass laminate. However, the LED PCB 1 is preferably of, but not limited to, a metal-core-board (MCB) type in which, as per FIG. 1*e*, there is the top-side general copper area 13, an insulating film 13*a* and an overall thermally conductive substrate 13*b*.

Between the power supply PC board and the HBLED PC board is a fan 7. Affixed to the fan are baffle elements 8 for directing air-flow. Affixed to the lower end of housing is an electrically conductive metallic screw base 9. In the side walls of the housing are air vents 10 for incoming and outgoing air.

The fan 7 situated under the substrate directs air in a perpendicular manner toward the underside of substrate. Baffle plates 8 attached to the fan cause air to be drawn in only on one side of the housing and to be expelled only though another side so as to prevent or greatly minimize the mixing of intake and exhaust air. The cooling effect of the incoming air upon the heated copper islands is directly and predictably related to the area of those copper islands and to the temperature, turbulence, volume and linear velocity of the moving air. Air is brought in and expelled though the vents 10 located around the periphery in the sidewalls of the housing 3.

In practice, AC-mains power is applied to the screw base 9 and then to the power supply circuit board 6. The power supply coverts the AC voltage to an appropriate DC low voltage, which is in turn applied to the HBLEDSs. The HBLEDs create a substantial amount of heat during operation. As shown in FIG. 1*d* each of these LEDs has terminals 11 for basic electrical connections and a center heat removal pad 12.

Figure 2A:
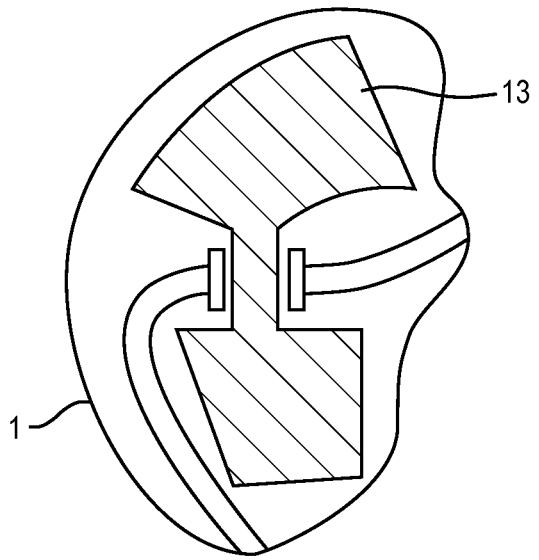
Figure 2B:
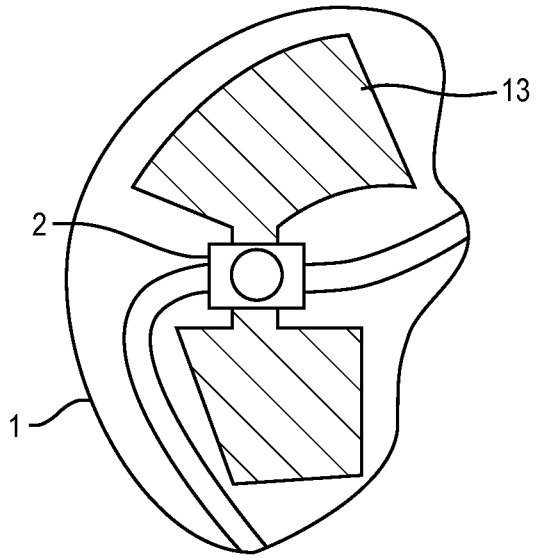
Figure 3:
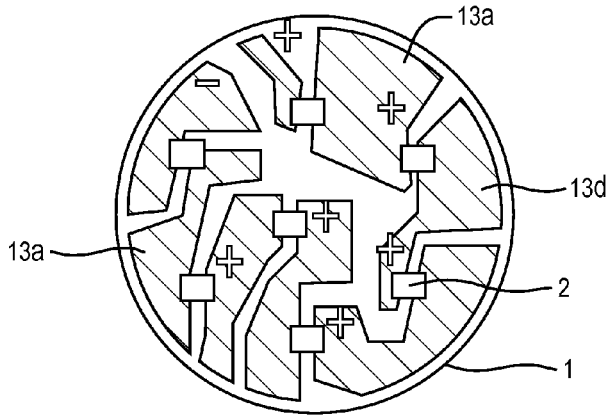
FIG. 3 is a diagram that shows an LED circuit board after assembly for the lamp of FIG. 1*a;*

FIG. 2 shows a typical HBLED PC-board mounting pattern before and after mounting of the HBLEDs. In this embodiment, the heat-removal surface 12 of the HBLED is surface mounted to a copper-metallized substrate area 12*a* as shown in FIGS. 2*a* and 2*b*, which is thermally connected to the larger copper area 13 so as to act as a heat spreader. FIG. 3 shows a view of the MCB with the individual LEDs 2 and the top-side LED-specific copper patterns 13*d*.

Figure 4:
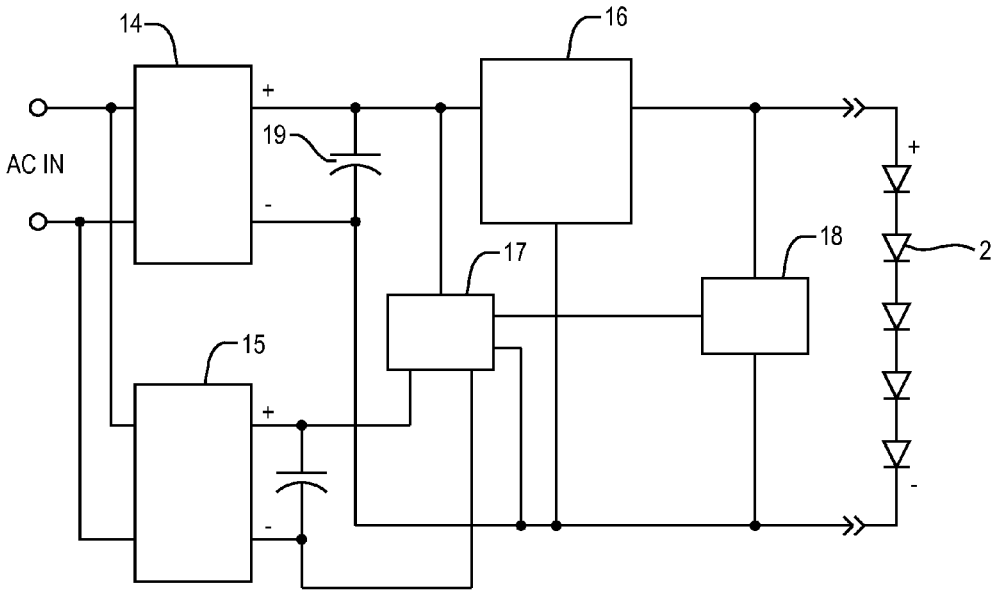
FIG. 4 is a block diagram of a power supply circuit for use with the lamp of FIG. 1*a;*

The HBLEDS receive their low voltage power from the constant-current switching power supply circuit PC board 6 reflected in the block diagram of FIG. 4. This block diagram is a simplified representation, showing main rectifier 14, auxiliary rectifier stage 15 a control and power regulation stage 16 and active-load stages 17 and 18.

This relevant circuitry, unlike many LED drivers, supplies the LEDs with constant DC voltage level having minimal ripple. A change in the RMS value of the input AC voltage causes the constant current level to be automatically programmed to a lower level, thereby causing a decrease in LED light level. The auxiliary rectifier/filter stage, which incorporates peak charging, establishes a constant DC output, even with small phase angles, ensuring that the control chip has the proper source voltage regardless of whether the input AC voltage has dropped with a lower dimmer setting.

When an attempt is made to dim a switching power supply without such as auxiliary rectifier/peak charge method, low phase angles associated with low light levels, results in drop-out or irregular operation of the control chip. The maintenance of a steady voltage to the control chip regardless of the phase angle removes or greatly reduces that aspect of possible instability and flicker at low light levels.

One of the issues with attempting to dim LED lamps with conventional phase control dimmers is that the EMI-filter capacitor in the dimmer creates an AC leakage path at very low dimmer settings. That leakage current causes parasitic LED illumination. Another issue is that dimmer EMI-filter inductance, interacting with the power supply EMI filtering components and with the control chip itself creates oscillations and flickering at low levels when the dimmer triac is firing and generating a fast-rising wave front. These effects can be prevented or minimized by having an input shunt resistance to bypass the parasitic AC leakage current and to dampen the flicker-causing oscillations. Similarly, LEDs have certain non-linear operating properties. These properties, in conjunction with the single-time constant circuits used in most dimmers can cause dimmers to vary brightness in ways which are non ideal.

For example, a phase control dimmer, driving an incandescent lamp, continues to supply some RMS voltage even as phase angles get very low. Because the resistive filament will conduct some current no matter how low the voltage is reduced. An LED string, however, operates differently. A typical white LED does not conduct current in proportion to the applied voltage as does the filament but rather will not conduct at all until the voltage is above about 2.5 volts. This in turn means that a series string of 9 LEDs will not conduct until the applied voltage is about 22.5V.

The switching power supply acts like a transformer and essentially steps down the input AC voltage. Without proceeding with a very technical discussion, suffice it to say that at full brightness, such a 9-LED string might have about 30 volts across it. It was just noted that such a string might not be conductive if the applied DC voltage is below about 22 volts, a level constituting about 70% of that at full brightness. That means if the input AC RMS voltage drops to about 70% of 120 VAC, or about 84 VAC, the LEDs will not be able to conduct.

If the light source had been an incandescent filament, there would be no such conduction "threshold and the filament would still be on and continue to glow as the voltage is reduced more and more until there is virtually no illumination. This threshold effect of LED strings is made worse by the fact that typical control chips also have certain startup operating traits which make it difficult for the control chip to deal with these LED non-linear thresholds.

That is, when tuning up the dimmer from zero, one typically finds that the light does not come up smoothly but rather "pops on" at some level above 30%, at which time it must be turned down somewhat if a very low light level is desired. In a similar aspect, when turning down an LED lamp, the illumination may turn off abruptly at some point above minimal brightness. This "pop-on" effect is well known to designers and users of lamp dimmers but when LEDs are added to the equation, the effect can be worsened.

It can be observed that if a shunt resistance is placed across the AC input (or DC side of the rectifier) and another across the LEDS, the non linear effects, along with any residual flickering effects, are greatly reduced, if not eliminated. The disadvantage of such resistances is that, to be effective, they have to be somewhat dissipative and degrade overall lamp efficiency at full brightness. For that reasons, the active load circuitry includes provisions for automatically disconnecting these resistances when the light level is set to more than moderate levels. The active load circuits also include provisions such that the disconnection or connection of the shunt resistances is achieved over a few seconds so that a viewer of the lamps does not perceive a sudden 5-10% increase or decrease in brightness as would otherwise occur.

Figure 5A:
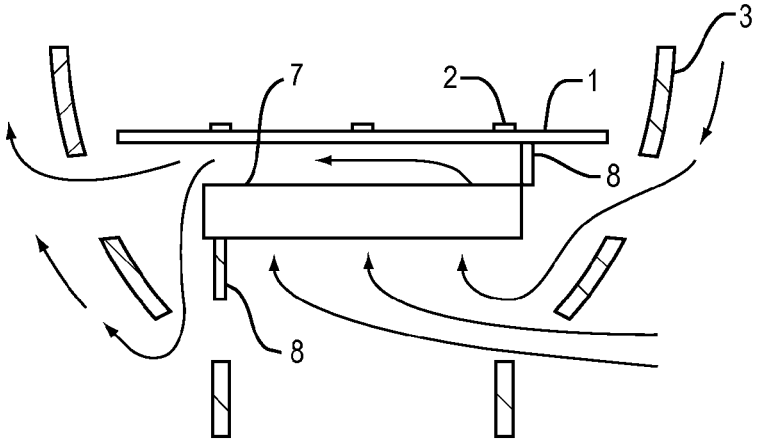

FIG. 5*a* shows a simplified view of the cooling mechanism. The air is drawn in through vents on one side of the housing and exhausted tough vents in the other side. The fan has baffle plates so that air can only be drawn in from one direction and existing air can only leave by another. In that way there is little or no mixing of hot warm and cool air outside of the housing. Because a) the total areas of the intake and exhaust vents in the housing is greater, respectively, than the intake and exhaust area of the fan itself, and fan speed is set rather low to begin with, for purposes of audible noise reduction, there is minimal air flow penalty and turbulent cooling effects come close to what can be achieved with no air vent constrictions at all.

The total area of the intake and outtake vents is preferably balanced to so that the fan is not starved for air and there is no excessive back pressure build-up. Larger intake and exhaust vents are preferable, but size is also limited by manufacturability and safety (e.g., as regulated by Underwriters Laboratories (UL). Final dimensions will therefore represent a balance of factors.

The fan speed and distance from the fan to the board are selected to achieve a form of what is known as impulse cooling. In this approach, enough air is directed toward the surface that it disrupts the thermal boundary layer structure that tends to form on the surface. This allows significantly more heat to be removed from the board than it would in traditional parallel-flow cooling arrangements or in perpendicular arrangements where the fan is not positioned to disrupt the boundary layer.

The fan receives its power from the same voltage output designated for the LEDs. When the lamp is dimmed, that voltage decreases and at some low light level, there is insufficient voltage to maintain fan operation. However, at low light levels, LED power and heat generation are greatly reduced, making fan operation unnecessary and as soon as the light level is adjusted upward, the fan voltage similarly increases and the fan turns back on.

The power supply PC board is positioned in the lower portion of the housing such that the principal filter capacitor, an electrolytic type, is located down into the screw base area. It is know that such electrolytic filter capacitors, typically used with AC mains rectifiers, decrease 50% in operating life for every 10 degree C. rise in ambient temperature. Therefore it is highly desirable to have such a capacitor as far away as possible from heat sources.

In this embodiment the principal heat source is the LED PC board. Having the electrolytic capacitor situated where it is allows the power supply PC board to act as thermal barrier even thought the LED board is air cooled, it still can reach temperatures above 75 C-80 C. The incoming cool air first passes by the power supply board before being directed toward the LED board, keeping its temperature rise above ambient to a few degrees. This guarantees that the electrolytic capacitor, being on the other side of the air-cooled power supply board, will be no warmer than the power supply board, regardless of what is happening with LED board.

It should be noted that with most LED lamps, operating in a base in position and no air flow, there is significant heat build up in the base of the lamp and an electrolytic capacitor in the base would experience significant temperature rise and lifetime degradation. In this embodiment, because of the circulating air such a positional thermal gradient is reduced to negligible importance, even in relatively airtight fixture.

Figure 5B:
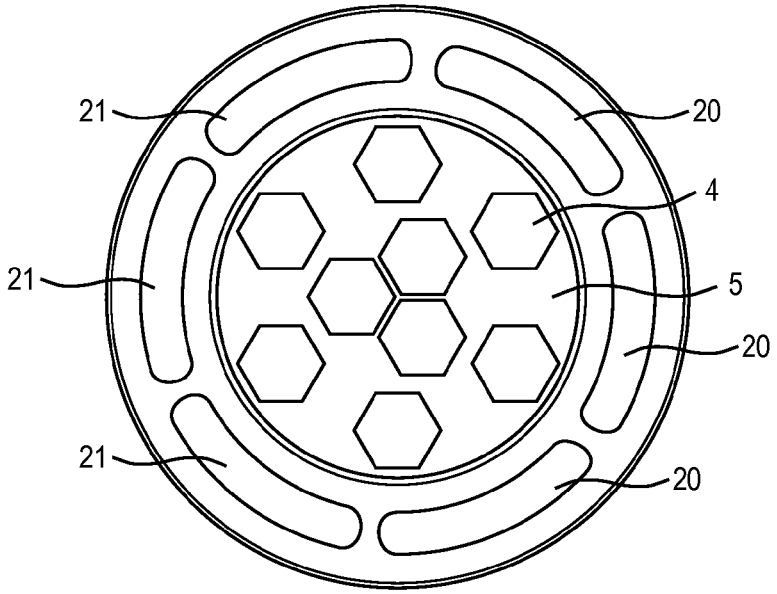
Figure 5C:
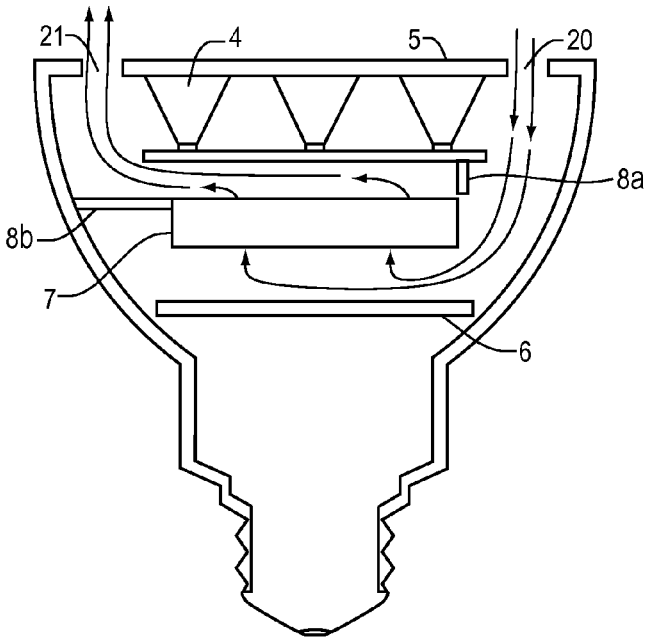
Figure 5D:
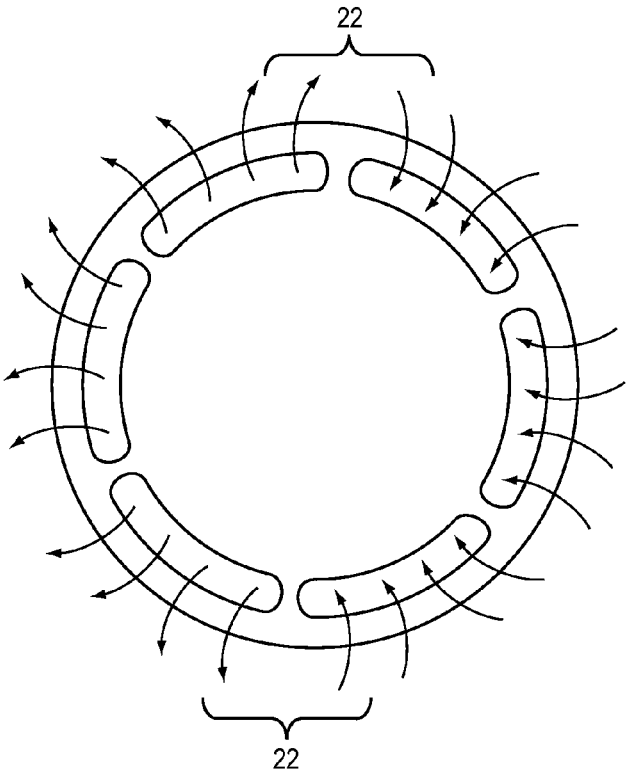

FIGS. 5*b-d* show a further embodiment wherein air flow, instead of entering and exiting peripherally as in FIG. 5*a*, enters in same plane as the light emitting surface.

As in FIG. 5*a*, the air movement is baffled so that air entering the intake vents 20, reaches the intake side of the fan but is kept from the exit side of the fan by one of the baffles 8*a*. Similarly, air leaving the fan and exit vents 21 is kept from entering the fan by a second baffle 8*b*. In this embodiment, the fact that air is entering in two adjacent quadrants and exiting in two opposite but adjacent quadrants tends to minimize the mixing of cooler intake air with hotter exhaust except in the two places 22 where opposite-direction air collides.

FIG. 6 shows a simplified view of the lens array which acts as a lamp cover as well as a collimating mechanism for each LED. Each lens 19 is designed as a TIR lens. Those skilled in the LED industry are familiar with the principal of Total Internal Reflection (TIR) and how those principles are used in TIR lenses for LEDs.

The lower conical portion of the lens is situated on top of the LED 2. The emitted light, which normally leaves the LED in an angle of about 140 degrees, can be focused down to a beam having an angle as little as 5-10 degrees. When a multiplicity of LEDs each have such a lens and are precisely aligned, it can be observed that the individually collimated beams merges to create a single collimated beam having an angle similar to that one any single LED.

In one embodiment, FIG. 6, the lenses are placed very close together as in a honeycomb manner 20 This results in the group of LEDs, when illuminated, more closely resembling the bright center area of a traditional incandescent PAR lamp. Most LED lamps employ LEDs and lenses which have a separation between them so that from a distance one sees multiple bright spots instead of a single light source. This is known as the "pixel" effect and is often undesirable.

The entire lens housing cover with integral lenses is fabricated with an optically clear plastic and in the area outside of the main light-emitting honeycomb pattern, there is a light-diffusive pattern in the transparent material 25. As a result, any reflected light in the space above the LED PC board 1 and just under the surface of the transparent cover, but outside of the LED area, can manifest itself as a slightly illuminated surface as seen by a viewer of the lamp from a distance. In any LED lamp of this type there is not 100% lens efficiency, resulting in some small amount of light scatter or light leakage from the lens. This technique simply uses that "wasted' light to advantage to cause the entire surface of the lamp to have some illumination, thereby contributing to the objective of having the lamps surface appear as much as possible like a traditional PAR lamp.

Referring to FIG. 6*c*, in an alternate embodiment to address these considerations relating to appearance, several low power white LEDs 24, drawing only a few milliamps, are mounted and appropriately connected on the same substrate as the principal HBLEDs. These low power LEDs, coupled with the lens array diffusive pattern easily provide enough distributed backlight to provide even more illumination of the peripheral portions of the lamp cover to achieve the total white appearance of the lamp cover/lens surface as just noted.

In a further embodiment, the transparent lens array is made of a material which is slightly tinted red, virtually indistinguishable when the lamp is off and absolutely indistinguishable when the lamp is on. The purpose of the tint is related to what is known as the Color Rendition Index (CRI) of the lamp. The CRI of any lamp relates to its ability to faithfully reproduce colors as they typically might be seen mid day sunlight.

Incandescent lamps have a CRI of 100. High brightness white LEDs typically have a CRI between 80-85, with several types claiming 90. There is much debate in the industry as to the validity of CRI as a metric because it is often stated that its characteristic wavelength peaks suggest its spectral output cannot be legitimately compared with broadband spectral characteristic of daylight or the output of an incandescent lamp.

It is further often noted that more useful in a white LED than having a CRI of at least 85 might be to not necessarily increase its CRI to 95 but rather to address an acknowledged shortcoming when LED lamps are rigidly compared against an incandescent lamp. Such a comparison typically shows that the LED lamp will not reproduce the color red as accurately as an incandescent lamp. In the trade, the incandescent lamp is said to have "punch" and while the white LED lamp does not. The achievement of such "punch" with regard to red content has been elusive, although prior art does reflect several approaches to solve the problem, including augmentation with red LEDs. There are at least two white LEDs on the market with claims of CRI above 90, but still without ideal red reproduction. These LEDs have a substantial penalty in lumen output. If the result were ideal relative to red reproduction, the lumen penalty would be more acceptable.

It has been determined that an appropriate minor red tint of the transparent lens array material will attenuate the shorter wavelengths to a sufficient degree to make the longer wavelengths, such as red, slightly more evident. The decrease in lumen output is not markedly different from that experienced with the available high CRI LEDs, which although they are called high-CRI, do not deliver the desired result. An advantage to this approach is that the apparent improved reproduction of red can be achieved with the same LED is being used for other production, without need for an alternate part. The cost to implement a tint in the lens array is negligible.

The present invention has now been described in connection with a number of specific embodiments thereof. However, numerous modifications which are contemplated as falling within the scope of the present invention should now be apparent to those skilled in the art. For example, a variety of equivalent circuit substitutions can be made without changing the underlying purposes of the circuit. Functions can also be combined to achieve a different circuit breakdown, and some functionality may not be necessary in all embodiments. And digital, processor-based techniques could also be used to implement circuit functionality where appropriate. It is therefore intended that the scope of the present invention be limited only by the scope of the claims appended hereto. In addition, the order of presentation of the claims should not be construed to limit the scope of any particular term in the claims.

What is claimed is:

1. A directional illumination source, comprising:

a directional housing extending from a base in a first direction, wherein the directional housing includes a first end connected to the base and a second end that is wider than the first end and spaced away from the first end, a plurality of LED illumination elements that are mounted proximate each other in a central cluster with respect to the housing opposite the base and leaving a peripheral space around the cluster, wherein the peripheral space is significantly larger than a separation between the LED illumination elements in the cluster, wherein an axis of illumination of each of the LED illumination elements faces at least generally in the first direction, a plurality of lens elements each aligned with an illumination axis of one of the LED illumination elements and wherein at least part of the peripheral space is outside of the direct illumination path of all of the LED illumination elements, a light-transmitting housing cover mounted with respect to the housing at the second end in front of an axis of illumination of the LED illumination elements, wherein the light-transmitting housing cover is mounted generally normal to the first direction and includes a light diffusive pattern in front of the peripheral space that is optically coupled to the LED illumination elements to distribute light around the diffusive pattern outside of the direct illumination path of all of the illumination elements when the illumination elements are on, and wherein the directional housing, the LED illumination elements, the lens elements, and the light-transmitting housing cover are part of a replacement PAR-type lamp.

2. The illumination source of claim 1 wherein the light transmitting housing cover includes the plurality of lens elements that are each aligned with an illumination axis of one of the LED illumination elements.

3. The illumination source of claim 1 wherein the outside diameter of the illumination source at the cover is at least 2.5 inches in diameter.

4. The illumination source of claim 1 wherein the nominal outside diameter of the illumination source at the cover is at least 3.75 inches in diameter.

5. The illumination source of claim 1 wherein the nominal outside diameter of the illumination source at the cover is at least 4.75 inches in diameter.

6. An illumination source, comprising:

a housing, a plurality of LED illumination elements that are mounted with respect to the housing and positioned to provide illumination outside the housing, a light transmitting housing cover mounted with respect to the housing in front of an axis of illumination of the LED illumination elements and including a diffusive pattern, wherein at least part of the peripheral space is outside of the direct illumination path of all of the LED illumination elements, and at least one smoothing LED positioned to couple its output to the diffusive pattern to distribute light around the diffusive pattern outside of the direct illumination path of all of the illumination elements, positioned proximate the LED illumination elements, and having a power output that is lower than the LED illumination elements.

7. The illumination source of claim 6 wherein the light transmitting housing cover includes a plurality of integral lens elements each aligned with an illumination axis of one of the LED illumination elements.

8. The illumination source of claim 6 wherein the smoothing LED is white.

9. The illumination source of claim 6 wherein the illumination source is part of a replacement PAR-type lamp.

10. The illumination source of claim 1 further including at least one smoothing LED coupled with the diffusive pattern, positioned proximate the LED illumination elements, and having a power output that is lower than the LED illumination elements.

11. The illumination source of claim 10 wherein the smoothing LED is white.

12. The illumination source of claim 10 wherein the light transmitting housing cover is tinted.

13. The illumination source of claim 12 wherein the light transmitting housing cover is tinted red.

14. The illumination source of claim 1 wherein the light transmitting housing cover is tinted.

15. The illumination source of claim 14 wherein the tinted light transmitting housing cover includes a plurality of integral lens elements each aligned with an illumination axis of one of the LED illumination elements.

16. The illumination source of claim 14 wherein the tinting is a high-pass filter operative to attenuate shorter wavelength light, so as to increase the lamp CRI (Color Rendition Index) number over what it would be using the same LED illumination elements, but without the high pass filter.

17. The illumination source of claim 14 wherein the light transmitting housing cover is tinted red.

18. The illumination source of claim 1 wherein the light transmitting housing cover is generally flat.

19. The illumination source of claim 6 wherein the light transmitting housing cover is generally flat.

* * * * *